United States Patent [19]

Cradeur et al.

[11] 4,156,421

[45] May 29, 1979

[54] METHOD AND APPARATUS FOR PRODUCING THERMAL VAPOR STREAM

[75] Inventors: Robert R. Cradeur, Spring; John S. Sperry, Houston; Richard W. Krajicek, Sugar Land, all of Tex.

[73] Assignee: Carmel Energy, Inc., Del.

[21] Appl. No.: 820,465

[22] Filed: Aug. 1, 1977

[51] Int. Cl.[2] ..... F24H 1/20

[52] U.S. Cl. ..... 126/360 A; 60/39.57; 166/303

[58] Field of Search ..... 126/360 R, 360 A; 431/158; 166/303, 11; 60/39.55, 39.57, 39.65

[56] References Cited

U.S. PATENT DOCUMENTS

| | | | |
|---|---|---|---|
| 2,530,271 | 11/1950 | Swindin | 126/360 A |
| 2,638,895 | 5/1953 | Swindin | 431/158 X |
| 2,900,975 | 8/1959 | Northcott | 126/360 A |
| 2,902,029 | 9/1959 | Hill | 126/360 A |
| 4,062,405 | 12/1977 | Drew | 166/303 X |

*Primary Examiner*—Edward G. Favors

*Attorney, Agent, or Firm*—Pravel, Wilson & Gambrell

[57] ABSTRACT

Method and apparatus for producing a thermal vapor stream for injecting into a subterranean formation for the recovery of liquefiable minerals therefrom, including a pressure vessel containing a high pressure combustion chamber for producing a heating gas for introduction into a heating gas injector. The heating gas injector is partly immersed in a steam generating section of the pressure vessel such that the heating gas is passed through the steam generating section to produce steam and combustion products which are directed between the pressure vessel and the combustion chamber for simultaneously cooling of the combustion chamber by further heating of the steam and combustion gases.

9 Claims, 10 Drawing Figures

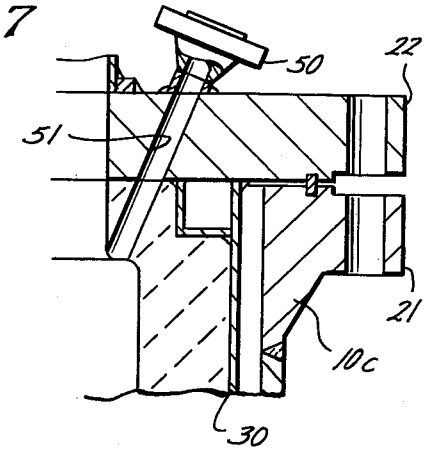
Fig. 7
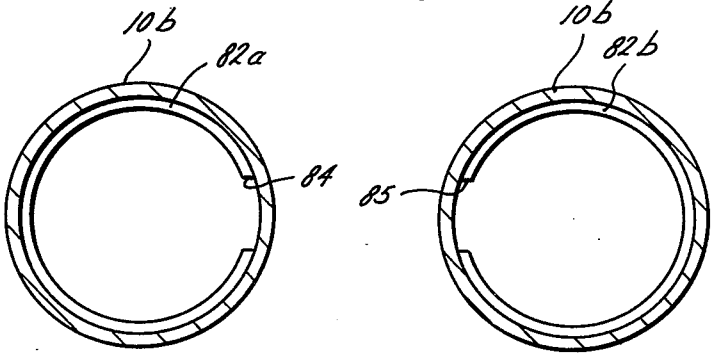
Fig. 8
Fig. 9
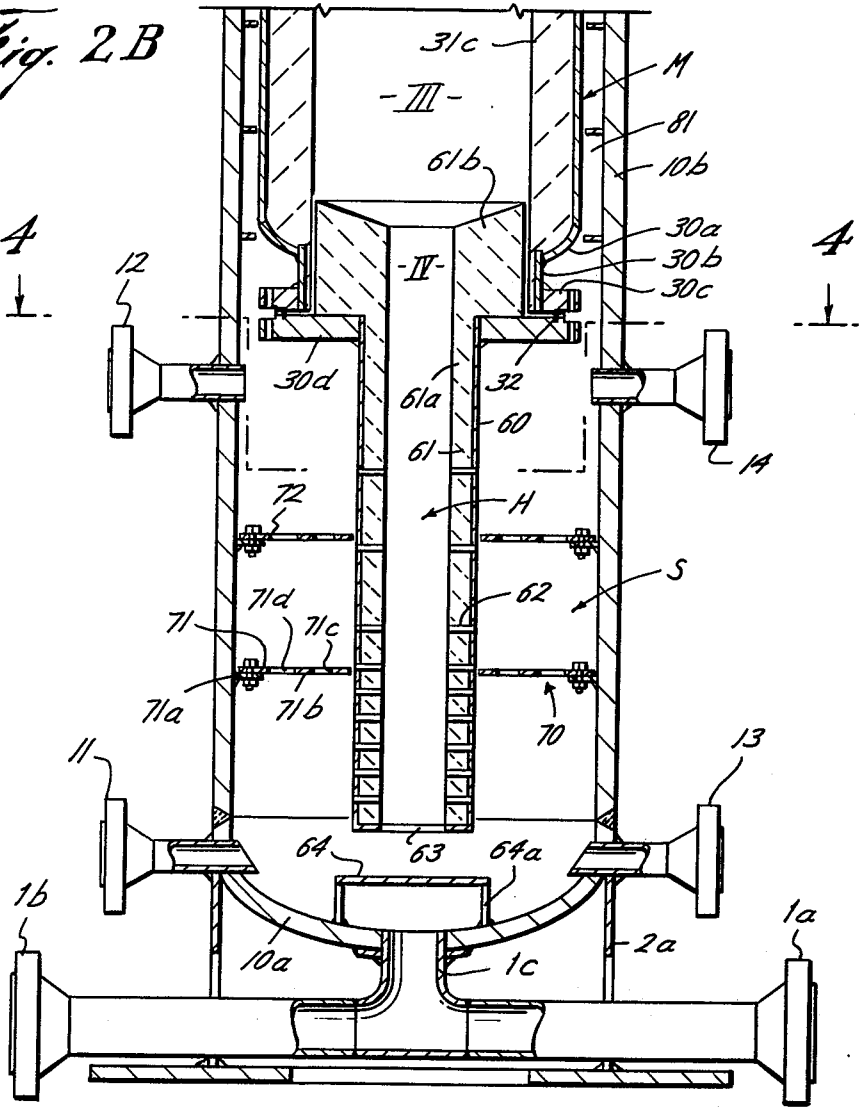
Fig. 2B

METHOD AND APPARATUS FOR PRODUCING THERMAL VAPOR STREAM

BACKGROUND OF THE INVENTION

This invention relates generally to hot fluid generators and in particular to steam generators for the recovery of liquefiable minerals from subterranean formations.

Apparatus for the sucessful recovery of minerals using a high pressure thermal vapor stream typically involves the production of hot combustion gases for flow into a steam generating device for producing sufficient quantities of high pressure thermal vapor of steam and combustion gases which are injected into the subsurface formation for economical recovery of highly viscous petroleum therefrom. Examples of some such apparatus are described in the following U.S. Pat. Nos. to name a few: 3,980,137; 3,620,571; 2,916,877; 2,839,141; 2,793,497; 2,823,752; 2,734,578; 2,754,098; and Mexican Pat. Nos. 105,472 and 106,801. Certain very viscous hydrocarbon deposits need large amounts of heat applied thereto to reduce the viscosity to make possible recovery. Because of the very large amounts of heat that are generated and required, difficulties arise in protecting the combustion chambers of thermal vapor generators from overheating while still having the capability of providing sufficient heat of formation to effect oil recovery.

SUMMARY OF THE INVENTION

This invention is a new and improved version of generators of steam for injection into an oil well or the like and includes a pressure vessel having a combustion chamber housing mounted therein. A heating gas injector is mounted onto the combustion housing for directing heating gas produced in the combustion chamber into water to produce steam and combusted products. The pressure vessel and combustion chamber housing cooperate to provide combustion chamber cooling means for directing the steam and combusted products along the outside of the combustion chamber housing to simultaneously partly cool the combustion chamber and further heat the steam prior to injection into a subterranean formation.

BRIEF DESCRIPTION OF THE DRAWINGS

FIGS. 2*a* and 2*b* represent a cross-sectional view of the apparatus of FIG. 1 taken along line 1—1 of FIG. 3;

FIG. 7 is a broken cross-sectional view of the view port entry means;

FIG. 8 is a cross-section of a pressure vessel with the combustion chamber removed illustrating a first set of annular baffles; and, FIG. 9 is a view comparable to FIG. 8 illustrating a second set of annular baffles.

BRIEF DESCRIPTION OF THE PREFERRED EMBODIMENTS

Figure 1:
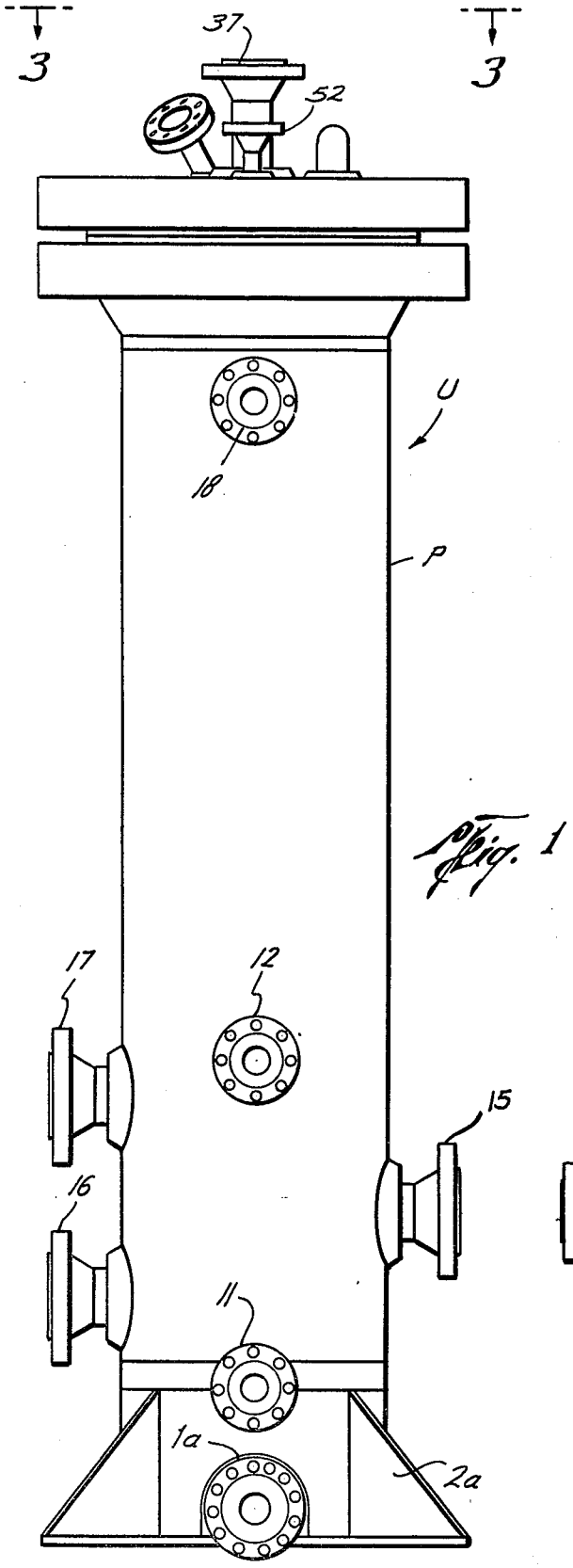
FIG. 1 is an elevational view of the thermal vapor unit of the preferred embodiment of this invention.

Referring now to the drawings, in FIG. 1 the letter U generally designates the new and improved high pressure thermal vapor unit of the preferred embodiment of this invention. The thermal vapor unit U includes an outer pressure vessel P which is made of suitable steel for withstanding the high temperature and pressure resulting from the operation of the apparatus. A combustion chamber C is mounted within the pressure vessel P; and a heating or hot gas injection means H is connected with the combustion chamber. A steam generation unit S of the vessel P surrounds the hot gas injection means H with a water supply. Heating gas produced in the combustion chamber C is directed through the hot gas injection means H and outwardly into the water in the steam generation unit S, which produces steam and combustion products gas. The steam and combustion products flows through combustion chamber cooling means M to simultaneously partly cool the combustion chamber C and receive further heat prior to flow of the additionally heated steam and combustion products gas outwardly of the pressure vessel P for use.

The pressure vessel P includes a bottom, dome shaped section 10*a*, a central cylindrical section 10*b* and a top end section 10*c*. A typical base support assembly 2*a* is provided for supporting the thermal vapor unit U on a trailer or other platform. Numerous conventional flange connections are attached to the pressure vessel P for connecting various components for the operation. Referring to FIGS. 1 and 2*b*, steam drum blowdown flanges, outlets 1*a* and 1*b* are shown.

Two level control flange outlets 11 and 12 are mounted in the pressure vessel section 10*b*. The level controller mounted on flanges 11 and 12, operate a water inlet valve to control the water level in the steam generation unit section S. An inlet supply flange connector 13 is mounted in vessel section 10*b* for connection with tubing which supplies the water which may be chemically treated to facilitate evaporation in the pressure vessel P. Such chemical treatment of water for pressure vessels is well-known in the art. A drum vent flange connector 14 is mounted in vessel section 10*b* for connection with suitable tubing and valves to allow venting of the steam generation unit.

Referring to FIG. 1, inspection port flange connectors 15, 16 and 17 are provided for connection with suitable viewing equipment and/or for physical access to the inside of the pressure vessel for repair and/or inspection.

The pressure vessel P further includes a flange connector 18 mounted in vessel section 10*b* for connection to suitable tubing for conducting high pressure combustion gases and steam (as explained more fully hereinafter) from the apparatus to a well being treated.

Pressure vessel top section 10*c* terminates with an annular flange 21 which is secured to the top section by suitable means such as by welding. Circular end closure plate 22 is mounted onto the top 10*c* of the vessel by connection to flange connector 21 by suitable means, such as bolts, with seal 23 preventing any leakage of the high temperature and pressure combustion gases and steam. The end closure plate 22 supports the combustion chamber C in the vessel.

Figure 2A:
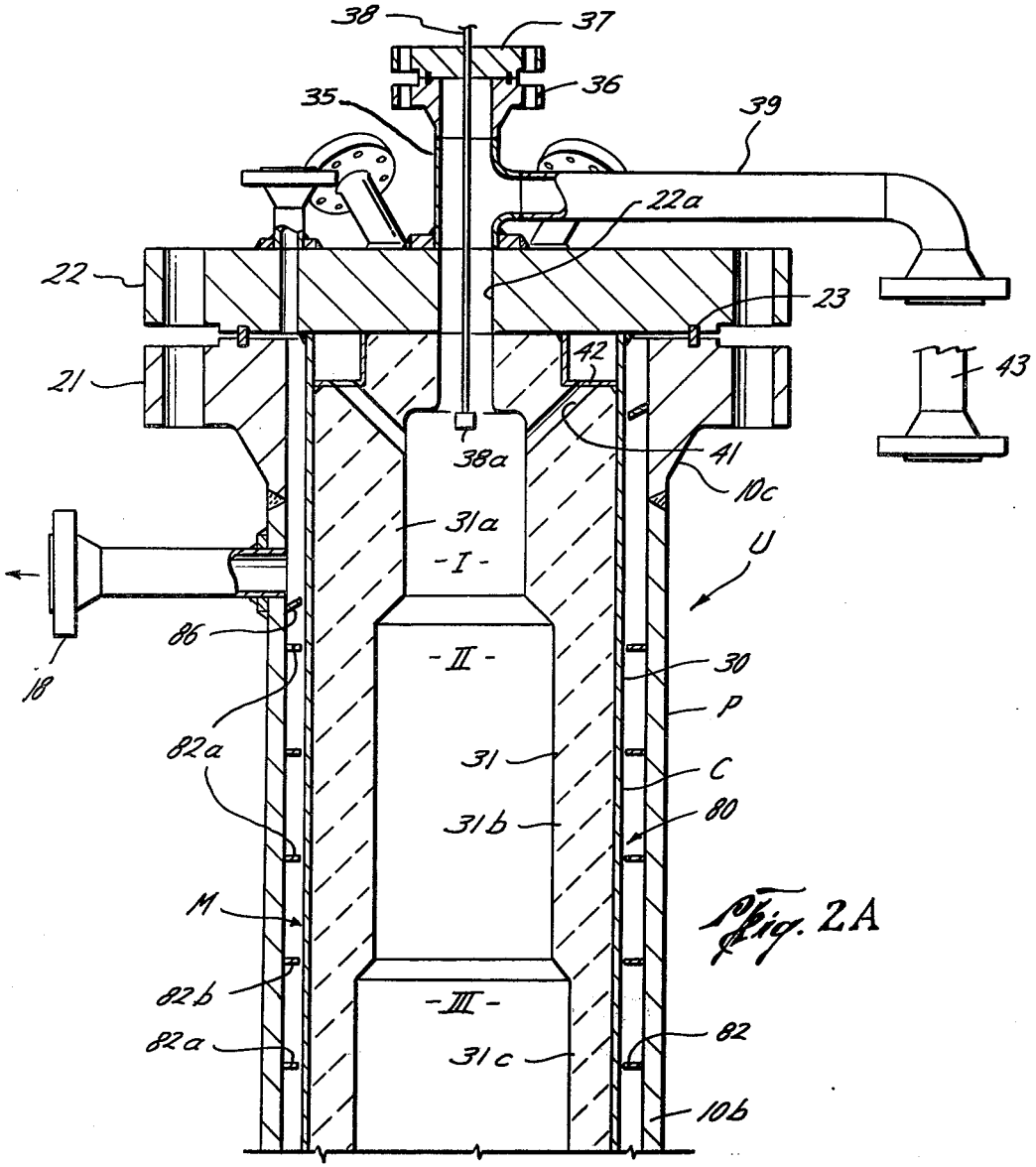

Referring now to FIGS. 2*a* and 2*b* of the drawings, the high pressure combustion chamber C preferably includes a substantially cylindrical pressure housing or casing 30, which is welded to end plate 22 at the top. The lower end of the pressure casing 30 terminates in converging section 30*a*, cylindrical section 30*b* and annular flange 30*c*. The flange 30*c* is connected to a flange 30*d* of the injection means H by suitable means, such as by bolts with a seal 32 to prevent escape of the gases at the connection.

The inner surfaces of the combustion chamber casing 30 are lined with a refractory material which forms a plurality of combustion zones I–IV. Combustion chamber casing 30 and the inner surfaces of sections 30*a* and 30*b* are lined with a continuous inner liner 31 of refractory material which forms the combustion zones I–IV. The continuous inner liner 31 of refractory material has portions of varying cross-sectional thicknesses for forming sections of varying inner diameters. The refractory material liner 31 includes a first cylindrical section 31*a* having a first inner diameter; the refractory liner section 31*a* extends longitudinally downwardly from the end member 22 a predetermined distance to form a first combustion zone I. Continuous with the first section is a second cylindrical section 31*b* having a relatively smaller cross-sectional wall thickness and hence a second, larger inner diameter extending longitudinally from the first section a predetermined distance within the pressure casing 30 to form a second combustion zone II. A third section 31*c* is integrally formed with lower section 31*b* and has an even larger inner diameter and extends longitudinally from section 31*b* to form a third combustion zone III. Casing sections 30*a* and 30*b* are also lined with cylindrical refractory material having the same internal diameter as in zone III. A fourth zone IV having a smaller inside diameter than zone III is formed by the hot gas injection means H.

The inside diameter and the longitudinal length of the combustion zones I–IV are related in that their values determine the volume of each combustion zone which effects the controlled expansion providing the desired turbulence and mixing of the fuel and air injected into the chamber. Such a combustion chamber is more fully described in U.S. Patent application entitled "COMBUSTION CHAMBER AND THERMAL VAPOR STEAM PRODUCING APPARATUS AND METHOD", Ser. No. 771,558, filed on Feb. 24, 1977.

Referring to the upper portion of FIG. 2A, mounted with the end member 22 is a tubular member 35 communicating with an opening 22*a* in the end closure member 22. Flange connector 36 is secured with the tubular member 35 and is adapted to be secured by suitable bolts with a closure flange member 37. A fuel supply line 38 having a nozzle 38*a* is mounted with the closure flange member 37 so as to position the nozzle 38*a* in combustion zone I. The fuel supply line is connected with a suitable fuel supply (not shown) for supplying fuel to the combustion chamber by injecting it in a spray form through nozzle 38*a*.

A first air supply line 39 is connected to the tubular member 35 for connection to an air supply (not shown) for delivery of air to combustion zone I through end member opening 22*a*.

Figure 5:
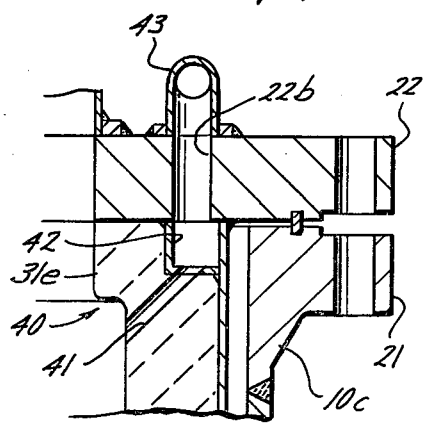
FIG. 5 is a broken cross-sectional view illustrating the secondary air entry port.

The combustion chamber C includes a second or secondary air stream injection means 40 which includes a plurality of passages 41 extending through a top portion 31*e* of the refractory material on the end closure member 22. Passages 41 are preferably eight in number and are circumferentially spaced about the nozzle 38*a*. Each passage 41 is vertically inclined and radially directed downwardly from an annular space 42. Annular space 42 is defined by the inside surface of the casing 30. As best shown in FIG. 5, the end closure member 22 includes an opening 22*b* communicating with the annular space 42. A secondary air supply line 43 is also connected with the air supply source (not shown). The plurality of passages 41 are preferably cylindrical and substantially evenly spaced circumferentially relative to each other and extend from the annular space 42 through the refractory material so that the respective longitudinal axes of these passages 41 intersect at a point on the combustion chamber longitudinal axis (which runs through the center of tube 38) a short distance downstream from the nozzle 38*a*.

It is believed that the air passages 41 should be oriented so that they direct the secondary air at or near the point of initial combustion. The burning or initial ignition of the fuel air mixture is believed to cause a swirling out effect with some unburned fuel at the exterior of the swirl. Accordingly, the secondary air is for mixing with any such unburned fuel to further facilitate combustion. The above description of the results of the preferred orientation of the secondary air supply passages is not based on known scientific theory. Whatever may be the reasons behind the obtaining of the substantially complete combustion which is obtained from the apparatus, it nevertheless occurs; there is no intent to limit the results and benefits obtained as based solely on the above description of operation or theory.

Figure 6:
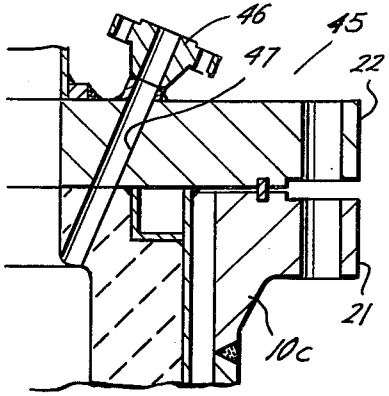
FIG. 6 is broken cross-sectional view illustrating the igniter entry point into the combustion chamber.

An electrical ignition assembly (not shown) is mountable in entry flange assembly generally designated as 45 illustrated in FIG. 6. A flange 46 is connected with a passage 47 which extends through the end closure member 22 and refractory material. A conventional ignition assembly (not shown) may be mounted with the flange 46 for extending through the passageway 47 into the first zone I of the combustion chamber for providing ignition to the hydrocarbon fuel. The ignition assembly may be a reciprocal longitudinally sliding ram which has a conventional electrical spark producing means positioned at one end. In operation, such a ram is longitudinally moved through the passage 47 to position the spark means adjacent the fuel injection nozzle 38*a*. The hydrocarbon fuel and pressurized air streams from a suitable compressor (not shown) are then supplied to the combustion zone I and an electrical spark is generated to ignite the fuel. After ignition, the longitudinal ram is pulled back into the passage for protection from the heat generated in the combustion zone I.

Returning to FIG. 7, a view port entry assembly 50 is connected with the end closure member 22 to communicate with passage 51 to provide a view port into the combustion chamber. A suitable sight glass (not shown) may be attached to the flange assembly 50 for viewing into the combustion chamber as is known in the art.

Figure 3:
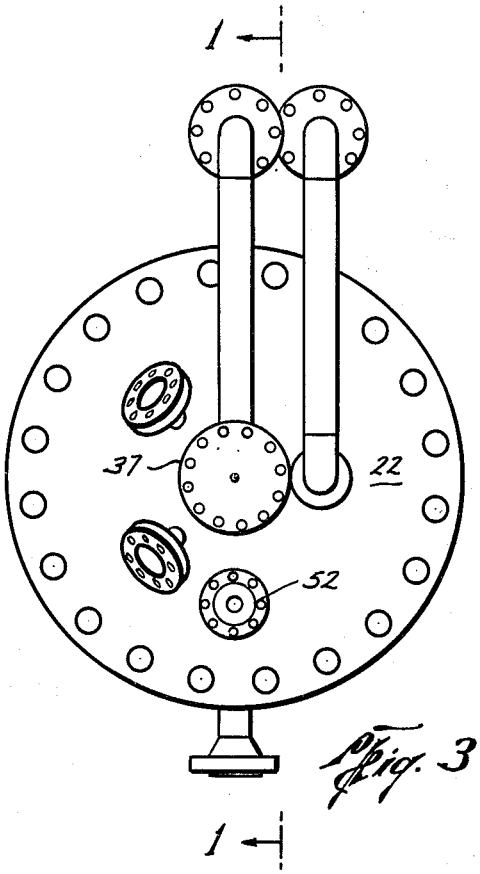
FIG. 3 is a top view of the apparatus taken along line 3—3 in FIG. 1.
Figure 4:
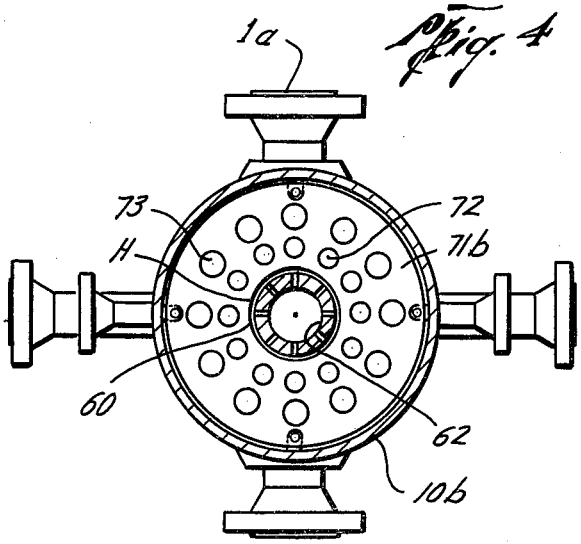
FIG. 4 is a cross-sectional view taken along line 4—4 in FIG. 2*b;*

As best shown in FIGS. 1 and 3, a flange assembly 52 is mounted on closure 22 over a passageway extending through an opening in the closure member 22, connecting to the annular space between the pressure casing 30, and the pressure vessel top section 10 to allow mounting of a relief valve upon the flange connector 52. Accordingly, should excess pressure build up inside the combustion chamber, the relief valve would activate to protect the apparatus from excess pressure.

The hot gas injection means H shown in FIG. 2*b* passes hot gases from the combustion chamber C to the steam generating portion S of the pressure vessel P for injecting the gases into a water bath or supply in the vessel 10. The longitudinal axis of the hot gas injection means H coincides with the longitudinal axes of the generally concentric vessel cylindrical section 10*b* and chamber casing 30. The hot gas injection means H includes a tubular housing member or section 60 which is lined with refractory material 61 so that the inside diameter of the refractory material is defined by cylindrical surface 61*a*. The refractory material 61 terminates at its upper end in an enlarged portion 61*b* which fits over and is supported on flange 30*d*. The internal surface of enlarged refractory material portion 61*b* forms zone IV of the combustion chamber C. A plurality of rows of radial openings 62 extends through the tubular member 60 and refractory material 61. There are preferably seven vertical rows of openings extending around the tubular member 60, which lies upon the same longitudinal axis as the pressure vessel section 10*b* and chamber casing 30. The lower end 63 of the tubular member 60 is open to allow for flow of combustion gases therethrough so as to strike impingement plate 64. The impingement plate 64 is spaced below opening 63 and is mounted on the inside of vessel bottom 10*a* by suitable supports 64*a*. The distance between adjacent rows of openings 62 increases from bottom to top of tubular member 60. The heating gases flowing through the injection tubular member 60 are caused to pass through the openings 62 into steam generator S which includes water therein for generating steam. A large portion of the gases will be directed through the opening 63 at the lower end of the injection tube member 60.

The steam generator unit S is formed in the lower part of the main cylindrical vessel section 10*b* and in the dome-shaped bottom 10*a*. The steam generator unit S includes a chamber which is formed by the lower portion of the main pressure vessel cylindrical housing 10*b* and the dome-shaped bottom 10*a* to hold water. The level of the water is typically slightly above or below the top row of radial openings 62 of the heating gas injection means H. A baffle assembly generally designated by the number 70 is mounted onto the interior wall of the main vessel section 10*b* in order to substantially consume the annular space formed between the main vessel section wall 10*b* and the tubular member 60 of the heating gas injection means H. The baffle assembly 70 includes two vertically spaced baffle units 71 and 72, which are identical except for vertical positioning. Each baffle unit 71 and 72 includes a mounting ring such as 71*a* which is welded onto the interior wall of the main vessel section 10*b* and further includes an annular baffle plate 71*b* which is bolted to the mounting ring 71*a*. The baffle plate 71*b* includes an inner set of openings 71*c* and an outer set of openings 71*d*, each set of openings being circumferentially spaced about the annular baffle plate 71*b*. Such a heating gas injection means H, steam generating unit S and baffle assembly 70 is discussed in some detail in U.S. Patent application Ser. No. 771,557, entitled "THERMAL VAPOR STREAM TEMPERATURE CONTROL APPARATUS AND METHOD", filed Feb. 24, 1977. The circumferentially positioned baffle openings or apertures 71*c* and 71*d* cause the break-up of the heating gases passing therethrough into smaller bubbles as the gas is passed through the opening so that the surface area of the combustion gas bubbles is greater, thereby increasing the efficiency of vaporization. Also, the baffles 71 and 72 act to retain the combustion gases in water longer than without the use of baffles.

A combustion cooling means generally designated by the number 80 is mounted about the combustion chamber housing 30 for passing the steam and combustion products rising upwardly from the water about the outside of the combustion chamber housing 30 for removing possibly damaging heat therefrom and simultaneously adding heat to the produced steam and combustion products prior to exit through vessel outlet 18. The combustion cooling means 80 includes an annular space or chamber 81 which is formed between the wall of the main vessel section 10*b* and the outside wall of the combustion chamber housing 30. The annular chamber 81 is in fluid communication with the steam and combustion products which rise upwardly out of the water of steam generating unit S. A plurality of vertically spaced baffles 82 are mounted by suitable means such as welding onto the inside wall of the pressure vessel section 10*b*. One set of baffles 82*a* is illustrated in FIG. 8 and a second set of baffles 82*b* is illustrated in FIG. 9. The baffles 82*a* and the baffles 82*b* are alternately spaced vertically within annular chamber 81 of the combustion cooling means 80. The baffles 82*a* include a slot 84 to allow for the flow of steam and combustion products upwardly therethrough. The baffles 82*b* include slot 85, which is positioned opposite from slot 84 on the outside of the housing 30 of the combustion chamber C for passing steam and combustion products upwardly therethrough. The slots 84 and 85 in the baffles 82*a* and 82*b*, respectively, are oriented 180 degrees apart from each other in order to uniformly circulate the steam and combustion products circumferentially about the exterior of the combustion chamber housing 30. In this manner, the entire outer combustion chamber housing surface or skin is contacted by the flow of steam and combustion products so as to transfer heat from the combustion chamber to the steam and hot gases to avoid hot spots in the combustion chamber that could otherwise result in failure. The flow of hot gases and steam over the surface of the combustion chamber cylindrical housing 30 also adds some heat to maintain the steam and hot gases in the super heat range which may be desirable for effectively treating of the well. An uppermost, inclined baffle 86 is positioned above the uppermost horizontally directed baffle 82*a* in order to assist in flowing the additionally heated gases outwardly through vessel outlet 18.

OPERATION AND USE OF THE INVENTION

In the operation of the thermal vapor generating unit U of the present invention, a high pressure air (or other oxidizer, stream is combined with fuel exiting nozzle 38*a* such that initial combustion takes place in chamber I of the compression chamber C.

Prior to such fuel ignition, a flowing stream of water, which may be chemically treated as is well known in the boiler art, is passed through entry flange connector 13 so as to provide a desired water level in the steam generator unit S. The amount of water which is maintained in the steam generator unit S is empirically determined upon operations to provide the desired amount of steam necessary to treat a well or other subterranean formation. The depth of water in the steam generator unit S can be regulated to further help control the temperature of the hot gas and steam exiting pressure vessel outlet 18.

The combusted gases flow from combustion chamber zone I sucessively through zones II and III into zone IV and radially outwardly through openings 62 in the hot gas injection means H or outwardly through bottom opening 63 thereof. The heating gases percolate and bubble through the baffles 71 and 72 located below the water line within the steam generator unit S. The passing of the heating gases through the baffles 71 and 72 generate steam or water vapor. The steam and combustion products rise upwardly into the annular space 81 of the combustion cooling means M and flow countercurrently upwardly in almost a helical flow pattern about the outside of the combustion chamber housing 30, such helical flow pattern being caused by the oppositely positioned slots 84 and 85 in adjacently vertically positioned baffles 82*a* and 82*b*, respectively. As the steam and combustion products flow upwardly through the annular space 81, heat from the combustion chamber C is transferred into the steam and heating gases thereby relieving some of the heat which might otherwise be damaging to the combustion chamber C and adding such heat to the steam and combustion products.

The foregoing disclosure and description of the invention are illustrative and explanatory thereof, and various changes in the size, shape, and materials as well as in the details of the illustrated construction may be made without departing from the spirit and scope of the invention.

We claim:

1. A vapor thermal unit for producing a high pressure steam and combustion products, comprising:

a substantially cylindrical pressure vessel having a substantially cylindrical, hollow main vessel section;

a combustion chamber formed by a combustion chamber housing mounted inside said main vessel section wall;

means for controlling expansion of combustion gases in said combustion chamber providing for turbulence and mixing of the fuel and air in said combustion chamber;

means for introducing fluid and air into said combustion chamber housing for producing a heating gas formed of combustion products;

said pressure vessel including a steam generating section containing water;

heating gas injection means attached to said combustion chamber housing for directing said heating gas into water in said steam generating section to produce steam;

said pressure vessel main wall section and said combustion chamber housing including combustion chamber cooling means for directing said steam and heating gas between said combustion chamber housing and main section wall for cooling said combustion chamber by further heating of said steam and combustion products to maintain said steam and combustion gases in the super heat range; and a pressure vessel outlet mounted in fluid communication with said combustion chamber cooling means for flowing outwardly of said pressure vessel such further heated steam and combustion products.

2. The structure as set forth in claim 1, wherein said combustion chamber cooling means includes:

an annular zone formed by said combustion chamber housing and pressure vessel main wall section.

3. The structure as set forth in claim 1, including:

means for flowing said water vapor and combustion products uniformly about said combustion chamber housing.

4. The structure as set forth in claim 1, wherein said heating gas injection means includes:

a tubular section mounted onto said combustion chamber housing and extending into said water of said steam generating section.

5. The structure as set forth in claim 4, including:

said tubular section being open at each end and including a plurality of radial openings for directly said heating gas from said combustion chamber into said water in said steam generating section.

6. A vapor thermal unit for producing a high pressure steam and combustion products, comprising:

a substantially cylindrical pressure vessel having a substantially cylindrical, hollow main vessel section;

a combustion chamber formed by a combustion chamber housing mounted inside said main vessel section wall;

means for introducing fluid and air into said combustion chamber housing for producing a heating gas formed of combustion products;

said pressure vessel including a steam generating section containing water;

heating gas injection means attached to said combustion chamber housing for directing said heating gas into water in said steam generating section to produce steam;

said pressure vessel main wall section and said combustion chamber housing including combustion chamber cooling means for directing said steam and heating gas through an annular zone formed by said combustion chamber housing and main section wall, and including a plurality of annular baffles positioned in said annular zone, each baffle having a slot to allow flow therethrough, for cooling said combustion chamber by further heating of said steam and combustion products; and a pressure vessel outlet mounted in fluid communication with said combustion chamber cooling means for flowing outwardly of said pressure vessel such further heated steam and combustion products.

7. The structure as set forth in claim 6, wherein:

said slots in adjacently positioned annular baffles are positioned on opposite portions of said combustion chamber housing.

8. A method of producing a vapor stream having an elevated temperature, suitable for injection into a subterranean formation for recovery of highly viscous petroleum comprising the steps of:

combusting a fuel-oxidizer mixture to obtain substantially complete combustion in an enclosed chamber, at sufficient pressure to cause the thermal vapor stream to enter the subterranean formation, to produce a heating gas formed of combustion products;

contacting the resulting heating gas with water for vaporizing a portion of the water to form the thermal vapor stream of combustion products and steam; and cooling the combustion chamber by flowing the resulting vapor stream about the combustion chamber for simultaneously cooling the combustion chamber and increasing the temperature of the vapor stream to maintain such vapor stream in the super heat range.

9. The method as set forth in claim 8 wherein said cooling step includes:

flowing the resultant mixture of vapor and combustion products in a countercurrent flow about the combustion chamber.

* * * * *

UNITED STATES PATENT AND TRADEMARK OFFICE

CERTIFICATE OF CORRECTION

PATENT NO. : 4,156,421

DATED : May 29, 1979

INVENTOR(S) : ROBERT R. CRADEUR, JOHN S. SPERRY, and RICHARD W. KRAJICEK

It is certified that error appears in the above-identified patent and that said Letters Patent are hereby corrected as shown below:

Please insert after the title: "The Government of the United States of America Has Rights in This Invention Pursuant to Contract No. EY-76-C-02-2880 Awarded by the U.S. Energy Research and Development Administration, Now the Department of Energy."

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*